US007610830B2

(12) United States Patent
Serrano Gil

(10) Patent No.: US 7,610,830 B2
(45) Date of Patent: Nov. 3, 2009

(54) FOLDING TILLER FOR BOATS

(76) Inventor: Marcos Serrano Gil, Madre Alberta Giménez, 8, 13ª, E-46018 Valencia (ES)

( * ) Notice: Subject to any disclaimer, the term of this patent is extended or adjusted under 35 U.S.C. 154(b) by 188 days.

(21) Appl. No.: 11/630,673

(22) PCT Filed: Jul. 1, 2005

(86) PCT No.: PCT/ES2005/000379

§ 371 (c)(1),
(2), (4) Date: Dec. 27, 2006

(87) PCT Pub. No.: WO2006/005782

PCT Pub. Date: Jan. 19, 2006

(65) Prior Publication Data

US 2007/0193492 A1 Aug. 23, 2007

(30) Foreign Application Priority Data

Jul. 2, 2004 (ES) ..... 200401618

(51) Int. Cl.
*B62D 1/04* (2006.01)
*G05G 1/10* (2006.01)
*B63H 25/10* (2006.01)

(52) U.S. Cl. ..... 74/552; 74/555; 114/160

(58) Field of Classification Search ..... 74/552, 74/555; 114/160
See application file for complete search history.

(56) References Cited

U.S. PATENT DOCUMENTS

| | | | | | |
|---|---|---|---|---|---|
| 1,002,663 | A * | 9/1911 | Fest | 74/555 |
| 1,104,524 | A * | 7/1914 | McKenzie | 74/555 |
| 1,268,505 | A * | 6/1918 | Sincare | 74/555 |
| 1,459,957 | A | 6/1923 | Merrirt | |
| 1,484,892 | A * | 2/1924 | Lobdell | 74/555 |
| 1,722,151 | A * | 7/1929 | Mantout | 74/555 |
| 2,106,169 | A * | 1/1938 | Erickson | 74/555 |
| 2,155,123 | A | 4/1939 | Gerardy | |
| 2,379,492 | A * | 7/1945 | Micuta | 74/555 |
| 3,209,615 | A * | 10/1965 | Fosnaugh et al. | 74/552 |
| 5,048,444 | A | 9/1991 | Moore | |
| 6,920,838 | B2 * | 7/2005 | Johns | 114/160 |

FOREIGN PATENT DOCUMENTS

| | | |
|---|---|---|
| JP | 58-030867 | 2/1983 |
| WO | WO 03/024785 A1 | 3/2003 |

* cited by examiner

*Primary Examiner*—Vinh T. Luong
(74) *Attorney, Agent, or Firm*—Breiner & Breiner, LLC

(57) ABSTRACT

A folding tiller for boats including a central fixed part and two essentially-symmetrical, opposing lateral segments which are articulated to the central part by respective hinges which are provided on two diametrically-opposed spokes of the tiller. The two lateral segments are folded down and stacked on top of the fixed part, in order to pass from an open extended position to a folded or retracted position. Moreover, respective longitudinally-opposing spoke segments are held in position by locking elements, at least while the tiller is to be maintained in the deployed configuration.

4 Claims, 3 Drawing Sheets

FOLDING TILLER FOR BOATS

FIELD OF INVENTION

The invention mentioned is a folding wheel for boats that is comprised of a fixed part and two movable parts that are joined to and fold over the fixed part when needed to change the size of the wheel from an extended condition, corresponding to the position of use, to a folded position, corresponding to a stationary condition, or vice versa.

The folding wheel, although appropriate for all types of boats, is especially suitable for sailing boats.

BACKGROUND OF THE INVENTION

Wheel control systems in boats demand that the wheel that controls the rudder differs considerably from one boat to another. This difference depends on variables such as the precision required on turning, the strength necessary to maneuver the wheel or the distance necessary to access the wheel.

In the case of sailing boats, the space in the area where the wheel is positioned is normally reduced, especially in small and medium sized sailing boats. This, along with the considerable size that wheels usually have in this type of boat, makes moving through this area complicated. Other activities are also uncomfortable because of the size of the wheel, especially when it is not being used for the steering of the boat.

The actual state of the art applied to sailing only knows wheels formed of an individual piece that generally includes in one plane a ring with spokes that come together in the center. These types of wheels have no means of folding or disassembling that allow their size to be modified or reduced, although some allow a position on deck so that they will not hinder anyone passing. For example, U.S. Pat. No. 5,048,444 describes a wheel for boats, assembled on a revolving spindle conveniently located on a handle or footing. The spindle is formed of two parts that are lined up and kept together by means of a revolving connection that has a turn direction perpendicular to the spindle so that the wheel can be turned from an operative position to an angular position of standby which does not hinder the way.

In another sense, JP 58-030867 describes a steering wheel for motorized vehicles in the form of a ring with three spokes and divided in three segments, each one of which is joined to a spoke. Each spoke is connected to a revolving handle by means of a revolving coupling that has a rotation axle perpendicular to the handle. So it is possible to fold the spoke and its corresponding segment to the center of the steering wheel and change its size, for example as to provide easier access to the vehicle, or exit from it. This idea could be applied to sailing, although it would not be of much use as only one segment of the ring could be folded at a time and the size of the steering wheel would only be reduced on one side and the part that had not been folded would still hinder movement on board.

WO 03/024785 describes a wheel that can be assembled on a wheel pedestal and is made up of a mostly circular form with an external rim for the user to hold and a central cube that defines the rotation axle L, said body being made up of a number of circular sections that are movable with respect to each other, so as to pass selectively from an operative open arrangement, where the circular sections are adjoining and together in the main extended position, to a final closed arrangement, where the circular sections are at least partly overlapped so as to reduce the size of the main extended position or vice versa. The adjustment from one arrangement to another requires the division and coaxial rotation of the circular sections and needs a wheel boss of complex format. The wheel eventually produced is expensive.

BRIEF SUMMARY OF THE INVENTION

The aim of this invention is the perfection of the described type of wheels, modifying the extended form of the wheels by means of folding its parts. With this, more space in the area near the wheel is gained and to also try to make the folding easy to use and cheap to manufacture.

This aim is considered achievable by means of a folding wheel for boats, which is made up of three parts designed appropriately and suitably connected together so that they can be folded onto each other allowing the wheel to be folded when not in use.

To this end, the wheel is built in three parts, and connected together so that the central part holds the folding side parts. The central part has been designed with spokes and parts of spokes. Each side section of the wheel has only parts of the spokes that, in their diametrical opposition and subsequent locking, will keep the wheel extended. After unlocking and folding both parts over the central fixed part, the wheel will remain folded.

The proposal for the invention of the folding wheel includes, generally in the same space, a holding peripheral ring for the user supplied with reinforcing spokes that are connected to a central hub built so that it can be turned in the pedestal that supports it. The main characteristic of the folding wheel is a central fixed part and at least two symmetrical side parts, opposing and kept connected to the central immobile part by hinges with at least two spokes in diametrical opposition in the wheel.

The side parts of the wheel will be folded and overlapped over the central fixed part by the helmsman of the boat when he pulls them towards himself, forcing them to fold at the joint, one after the other, against the central fixed part of the wheel when the folding is necessary and to modify the size of the wheel. The wheel will pass from an extended arrangement, coinciding with the use of the wheel, to a closed or folded arrangement, coinciding with the non-use of the wheel. According to the invention, the central immobile part and at least two of the mobile side parts will have parts of spokes that will be respectively and longitudinally opposed when the wheel is deployed, and will be out of such positions when the wheel is folded.

It is also a characteristic of the folding wheel that the invention suggests the idea that each respective longitudinally opposed part of a spoke be kept in place by locking elements, at least when it is necessary that the wheel be extended.

The turning of the side parts with regard to the central fixed part requires locking elements that will suitably and respectively allow the movements that lead to the folding of the wheel and to its subsequent unfolding to make up a sturdy wheel when it is needed for the steering of the boat.

These locking elements are preferably at least as to certain spokes of the wheel, made up of a series of independent joining bushes, for example spring-loaded bushes, nuts, etc., positioned near the end of each opposed spoke part so that continuity between them is achieved and causing rigidity in the second wheel spoke that will guarantee the extended arrangement of the wheel. On reversing the position of the blocking elements, the opposed parts of the spokes are separated from each other.

Combined with the mentioned second spokes of the wheel, other spoke parts included in the central fixed part and hinged to the corresponding and respective parts of the spoke included in each side part to form the third spokes of the wheel, as well as assuring the folding of the side parts against the central immobile part, allow the strengthening of the extended arrangement of the wheel.

So the central immobile part of the wheel is made up of opposing parts of the peripheral ring connected at the hub by means of, for example, the first wheel spoke and will also include parts of the spoke that when opposed and locked or joined with the corresponding and reciprocal parts of the spokes designed in both side parts will give way to the second and third spokes of the wheel that will keep it rigidly extended.

It is obvious, from the above, that the hinges that connect the respective and longitudinally opposed parts of the spoke are able to be designed in various forms. A non-limiting example of the design is that the hinges could be made up of holes and pins, screws threaded on the spokes, etc.

In a preferred embodiment, a folding wheel, according to the invention, includes, generally in the same plane, a peripheral ring provided with strengthening spokes that are connected to a hub and that is made up of a central fixed part with two opposing parts of the peripheral ring joined by continuous spokes, or the first spokes of the wheel, connected to the hub that turns on the wheel pedestal, from which parts of spokes that are shorter than the continuous spoke emerge.

Two side parts of the wheel, each made up from the peripheral ring of the same length and parts of spokes that begin inside and are directed to the center of the wheel correspond with parts of the spokes of the fixed part to make up the second spokes of the wheel. These are connected to the central immobile part by respective joints arranged in both diametrical opposed spokes in the wheel and provided in the example as joining strips secured with rivets to the respective ends of both opposing parts of the spokes, so as to allow the turning, folding and unfolding of the side parts over the central immobile part of the wheel.

Locking elements, specially provided as sliding locking elements, nuts in the example, located in the parts of the spoke of the side parts of the wheel or in the central fixed part, allow, with their screwing, fixing or sliding with regard to the respective opposing parts of the spoke of the central and side parts, the formation and rigidity of the third spokes of the wheel and with it, the locking of the wheel to keep it unfolded, or reversing the maneuver its unlocking so as to enable the folding of the wheel.

So as to provide a better understanding of what has already been described, with the description, a series of drawings are enclosed that show the preferred production of the invention, production that should not be considered as limiting the particular characteristics of the application made.

DETAILED DESCRIPTION OF THE PREFERRED EMBODIMENTS

Figure 1:
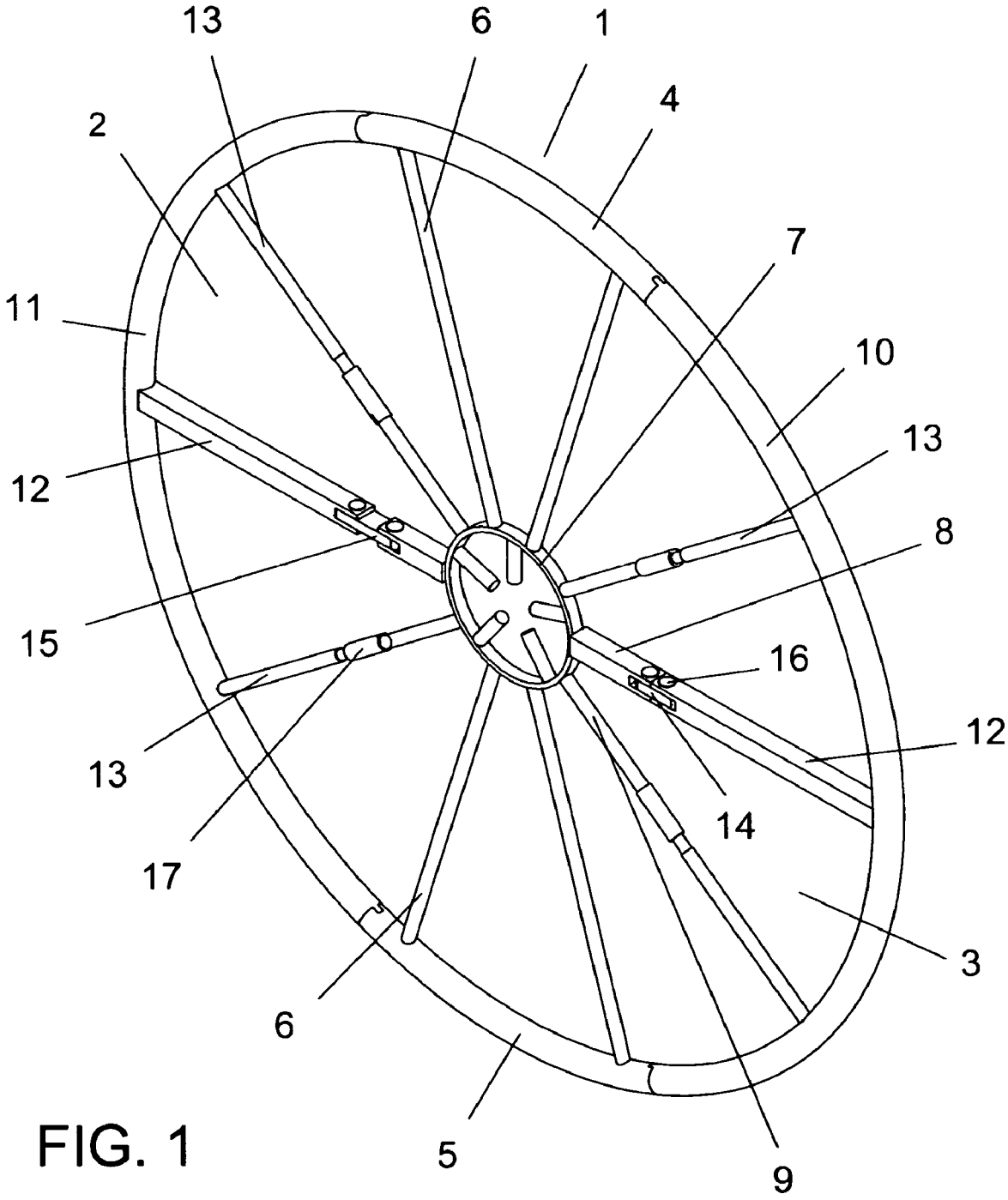
FIG. 1 shows, by means of an isometric perspective, a simple production of the folding wheel for boats with the side mobile parts extended in the same plane as the central fixed part and with the spoke parts locked by the locking elements.

From the Figures, it is easy to see that the folding wheel is made up from a central fixed part (1) and from two movable side parts (2) and (3).

The central fixed part (1) is made up from both opposing parts of the peripheral ring (4 and 5) connected by the first continuous spokes of the wheel (6) with the center (7) of the wheel, from which parts of the spokes (8) and (9) emerge. Spokes (8) and (9) are shorter than the continuous spokes (6) of the wheel.

Each one of the movable side parts (2) and (3) is made up from a part of the peripheral ring (10) and (11), from which extend to the center (7) of the wheel respective parts of the spokes (12) and (13).

The parts of the spokes (8) and (9) of the central fixed part (1) can be seen in FIG. 1 longitudinally opposed and corresponding with both the respective parts of spokes (12) or (13) of the side parts (2) and (3), making up, respectively, the second and third spokes of the wheel.

It can also be seen with the help of the Figures, especially FIG. 1, that the third spokes or intermediate hinge members of the wheel made up of the portions of the spokes (8 and 12, second hinge member and first hinge member, respectively), are joined at their respective intermediate strips (14 and 15) by a set of rivets (16), whereas the remaining spokes, made up of portions of spokes (9 and 13), are held longitudinally opposed to each other by the bushes (17) that form the locking elements.

The locking elements (17) are seen in FIG. 1 held to the opposed ends of each of the parts of the spokes (9 and 13) longitudinally opposed to each other, preventing the side moving parts of the wheel (2 and 3) from turning with respect to the intermediate strips (14 and 15) and on the turning axes that constitute the rivets (16). In the example, the intermediate strips (14 and 15) are of different lengths, being longer on the side of the second movable part (2), as it has to fold over the central part (1) and the first movable part (3), a greater depth than the other moving part (3). Also, the placing of a lengthened orifice (18) eases folding.

Figure 2:
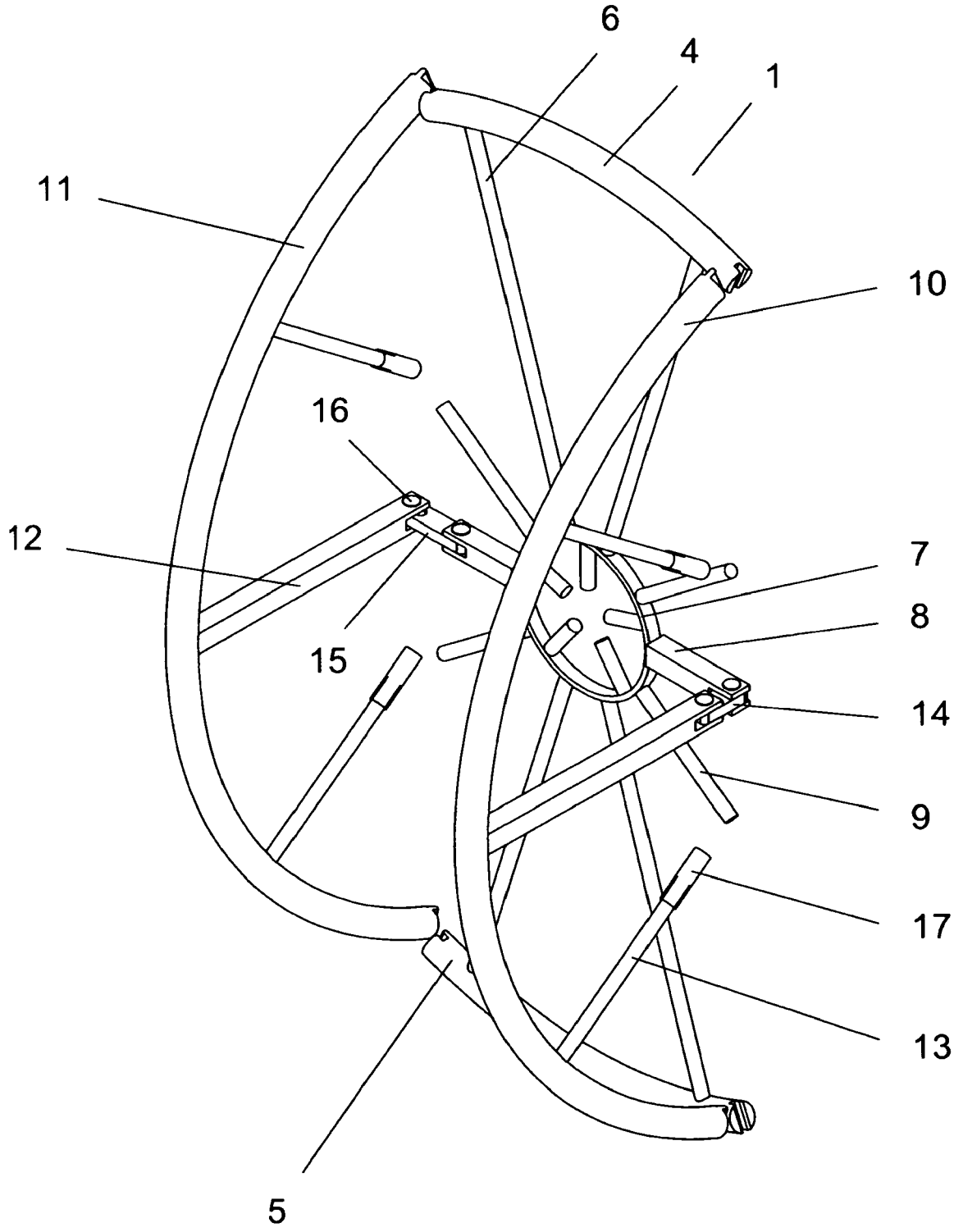
FIG. 2 shows an isometric perspective of the folding wheel for boats, corresponding to FIG. 1, but with the side moving parts moved halfway through their route, the moving parts forming a 90° angle with respect to the central fixed part, with the spoke blocked and the side parts connected to the central fixed part of the wheel by the hinges.
Figure 3:
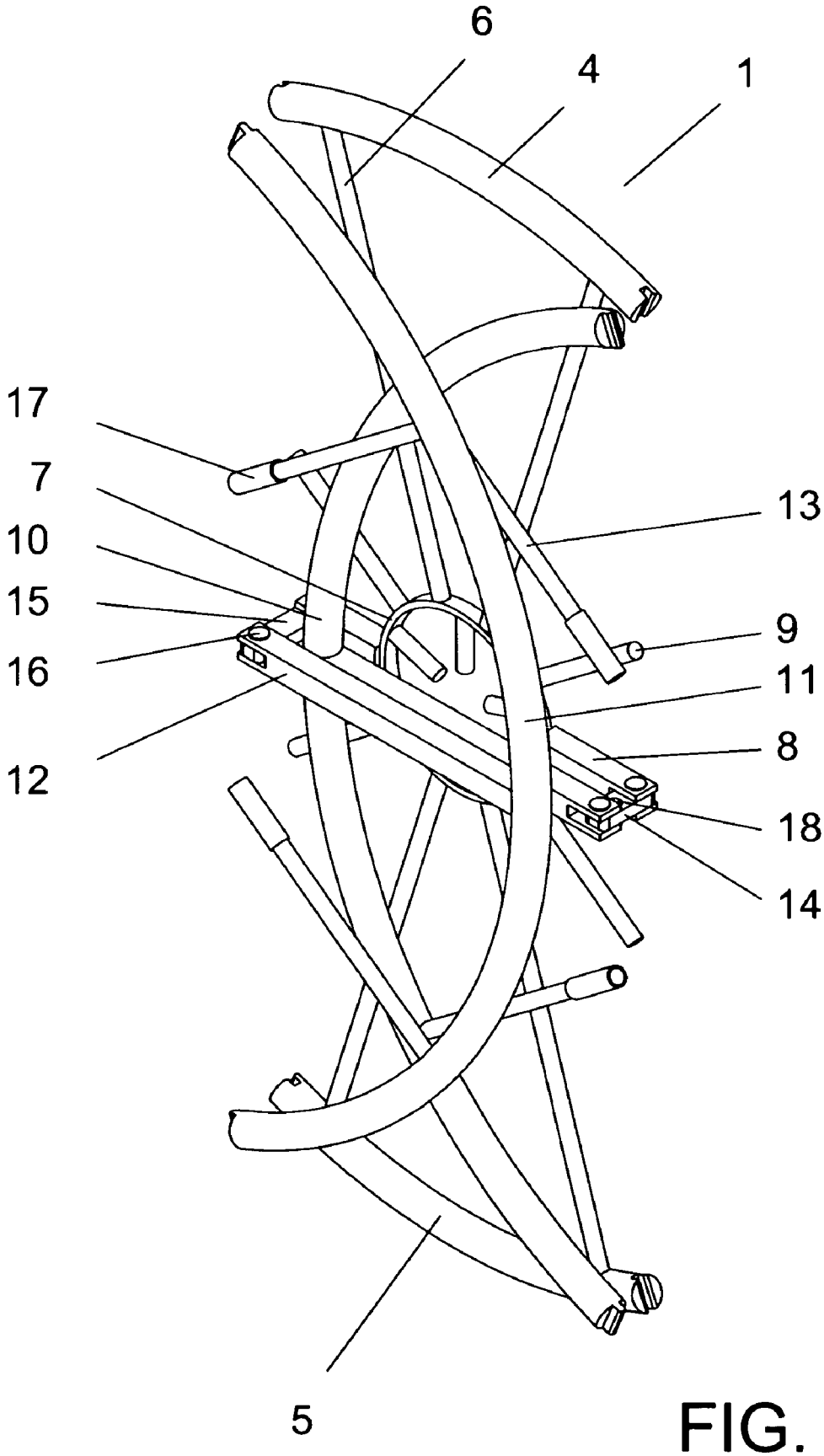
FIG. 3 shows, corresponding to FIGS. 1 and 2, an isometric perspective of the folding wheel for boats completely folded.

Thus, when it is wished to fold the wheel, the bushes or locking elements (17) of the second spokes of the wheel formed of the spoke portions (9 and 13), longitudinally opposed to each other, are moved by the helmsman from the locked position that they occupied to an unlocked position on any of the portions of the spoke (9 or 13), at which point the ends of the portions of the spoke are freed, thereby enabling the movable side parts (2) and (3) to turn on their joints (16) until they reach the intermediate and final points, respectively, as shown in FIGS. 2 and 3. The inverse procedure, carried out from the position shown in FIG. 3, leads to the deployed position of the wheel shown in FIG. 1.

In order to make the deployed configuration of the wheel more rigid, the portions of the peripheral ring (4, 5, 10 and 11) have suitable coupling means (19 and 20) at their ends.

The invention has been described in accordance with the illustrated method of execution. The possibility of producing modification details and/or of replacing certain elements or devices for others that are equivalent or of adding complementary devices of a known type is evident, without that being justification to be considered outside the framework of the invention.

The invention claimed is:

1. A foldable rudder wheel for a boat comprising a peripheral wheel having strengthening spokes which meet at a central turning hub, wherein the peripheral wheel comprises a plurality of parts, each of said parts being joined to at least one of said spokes, wherein said parts include a fixed central part and at least a first movable part and a second movable part substantially symmetrical to each other and combined with said central part by intermediate hinge members provided at diametrically opposed spokes of the peripheral wheel, wherein said intermediate hinge members include a first hinge member between said fixed central part and said first movable part, and a second hinge member between said fixed central part and said second movable part, wherein said first hinge member has a length longer than a length of said second hinge member; and including a plurality of coupling means on said peripheral wheel wherein a first of said plurality of coupling means is positioned between said fixed central part and said first movable part, and a second of said plurality of coupling means is positioned between said fixed central part and said second movable part;

wherein said second movable part is arranged to fold over said fixed central part and said first movable part is arranged to fold over said second movable part so as to be positioned alternatively in an open deployed position or in a folded position, and when in said folded position, said fixed central part is only connected to said first movable part and to said second movable part by said first hinge member and said second hinge member.

2. The foldable rudder wheel of claim 1, wherein when said central part and said first movable part and said second movable part are in the open deployed position, portions of said spokes present in said central part are longitudinally opposed to respective portions of said spokes present in said first movable part and said second movable part.

3. The foldable rudder wheel of claim 2, wherein said portions of said spokes of said central part are held in said longitudinally opposed position to said portions of said spokes of said first movable part and said second movable part by locking elements.

4. The foldable rudder wheel of claim 3, wherein said locking elements are present in relation to a spoke adjacent to each of said spokes having said intermediate hinge members.

* * * * *